United States Patent [19]

Straitz, III

[11] 4,139,339

[45] Feb. 13, 1979

[54] FLARE GAS STACK WITH PURGE CONTROL

[75] Inventor: John F. Straitz, III, Meadowbrook, Pa.

[73] Assignee: Combustion Unlimited Incorporated, Jenkintown, Pa.

[21] Appl. No.: 769,709

[22] Filed: Feb. 17, 1977

[51] Int. Cl.[2] ..... F23D 13/20

[52] U.S. Cl. ..... 431/202; 431/5; 431/14; 431/29; 422/168

[58] Field of Search ..... 431/5, 202, 13, 14, 431/29; 23/277 C

[56] References Cited

U.S. PATENT DOCUMENTS

| | | | |
|---|---|---|---|
| 2,734,562 | 2/1956 | Haberle et al. | 431/202 X |
| 2,888,981 | 6/1959 | Ripple | 431/202 X |
| 3,216,661 | 11/1965 | Sawyer | 431/14 X |
| 3,697,229 | 10/1972 | Frey et al. | 431/202 X |
| 3,901,643 | 8/1975 | Reed et al. | 431/202 |
| 3,994,663 | 11/1976 | Reed | 431/202 |

*Primary Examiner*—Edward G. Favors

*Attorney, Agent, or Firm*—Zachary T. Wobensmith, 2nd; Zachary T. Wobensmith, III

[57] ABSTRACT

A purge control system for flare gas stacks is described in which provisions are made for start up, steady state or transient purge gas control, and for failure of the purge gas supply, and also takes into account variable windspeed at or near the top of the stack, flow or non-flow of purge gas and waste gas in the stack, ambient temperature and temperature of the advancing gaseous medium in the stack, oxygen content of the gas at a predetermined location in the stack, the system including provisions for pilot burner gas supply and ignition with protection against pilot burner operation under undesired conditions, an indicating panel being employed to advise the operator of the prevailing operating conditions so that, if desired, appropriate action can be taken by the operator.

20 Claims, 4 Drawing Figures

FLARE GAS STACK WITH PURGE CONTROL

BACKGROUND OF THE INVENTION

1. Field of the Invention

This invention relates to flare gas stacks for waste combustible gases from industrial processes including oil refineries, and more particularly to the control of purge gas thereto.

2. Brief Description of the Prior Art

It has heretofore been proposed to supply purge gas to a flare stack to prevent the occurrence of explosions in the stack.

Reed, in U.S. Pat. No. 3,741,713, shows a purge gas admission control for a flare system as a function of the temperature, a temperature sensing element being mounted in the stack or flare stack or in the supply duct which is connected to the stack or flare stack.

While reference is made to the use of molecular seals in an effort to prevent downflow of air into the stack none of the important variables involved are recognized or utilized to control the flow of the purge gas into the stack.

Reed et al., in U.S. Pat. No. 3,901,643, show a temperature-pressure activated purge gas flow control system for flares which adds to the temperature control system of U.S. Pat. No. 3,741,713, a control based on the pressure of the gas being supplied to the stack. This system has a pilot fixture providing a constant flame but with no provisions for controlling the pilot and no signals to indicate whether the pressure controlled valves or the temperature controlled valves are functioning. In FIG. 1, a water seal is shown at the base of the stack which is intended to prevent backflow from the stack into the supply pipe but this would not be effective to prevent entry of air into the stack itself, visual check of the liquid level in the water seal may be made or a liquid level operated alarm may be used.

Weinman et al., in U.S. Pat. No. 3,924,605 employ wind sensors to effect closing of the top of the stack.

The purge gas control systems heretofore proposed leave much to be desired in that they fail to take into account conditions at start up, variations in windspeed at or near the top of the stack, failure of steady state or transient purge flow, oxygen content of the gases advancing in the stack, monitoring of the purge gas and waste gas flow, and control of the pilot and its ignition to avoid pilot operation which could cause an explosion in the stack. The prior systems also did not give any indication of the prevailing conditions or their operating status.

The control system of the present invention overcomes the shortcomings of the purge gas control systems heretofore available with increased safety for operating personnel, with decreased cost for personnel and with resultant energy conservation and savings due to reduced utilization of high cost purge gas.

SUMMARY OF THE INVENTION

In accordance with the present invention an improved purge gas control system for flare stacks is provided taking into account start up, steady state or transient purge gas control, failure of purge gas supply, flow or non-flow of purge gas and waste gas in the stack, oxygen content of the gas at a predetermined location in the stack, comparison of the ambient temperature and the temperature of the gasous medium at a selected location in the stack, and variable windspeed at the top of the stack as measured at a convenient location, the control system determining the flow of purge gas, the activation or non-activation of the pilots at the top of the stack and the ignition system controlled at the panel, and the provision of signals to advise the operator of the conditions prevailing in the stack system and the controls therefor.

It is the principal object of the invention to provide a purge gas control system for flare stacks which will have a greater degree of effectiveness and safety than the systems heretofore available.

It is a further object of the invention to provide a purge gas control system for flare stacks which takes into account factors not heretofore given adequate consideration, including the variable windspeed at the top of the stack, oxygen content of the gas at a predetermined location in the stack as well as other factors heretofore mentioned.

It is a further object of the invention to provide a purge gas control system which takes into account start up conditions in which the stack is full of air and monitors the removal of the air so that explosions in the stack can be prevented.

It is a further object of the invention to provide a purge gas control system which takes into account transient and change over conditions.

It is a further object of the invention to provide a purge gas control system for flare stacks in which the operator is advised as to prevailing operating conditions so that appropriate action can be taken.

It is a further object of the invention to provide a purge gas control system which can be applied to existing installations or new installations as desired.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
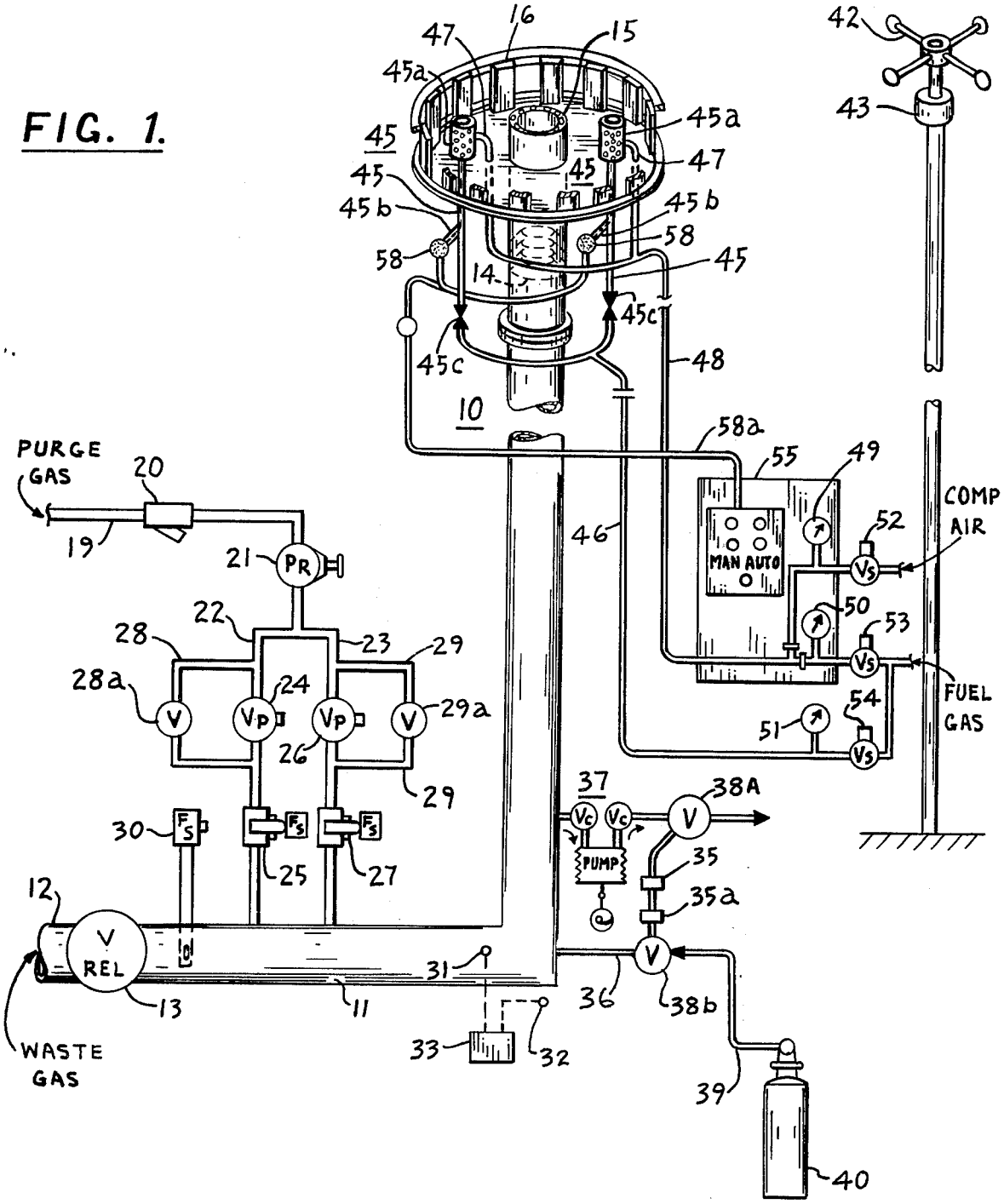
FIG. 1 is a diagramatic view of a flare gas stack with purge gas control in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

It is common to utilize a flare stack for the disposal of waste combustible gas from chemical processes and particularly from oil refining. Such stacks may be vertical, horizontal or inclined. The waste gas is not usually continuously available but is intermittently supplied.

The discharge end of the stack may have, as is customary, a flare stack burner for admixing the combustible waste gas and air for supporting combustion and additionally is preferably provided with a pilot, an ignitor for the pilot, and controls for the pilot and ignitor.

The stack can be supplied, if desired, with a fluidic seal as shown in U.S. Pat. No. 3,730,673, or can be supplied with a water seal of a type well known in the prior art. Also, if desired, the use of steam or other mediums for smokeless operation can be employed.

Various conditions must be accommodated including the condition at initial start up where the entire stack and its supply header are filled with air.

Another condition which must be accommodated is that in which the waste gas stops flowing and very high winds are present and effective at the discharge end of the flare stack so that steady state purge gas flow must be initiated, monitored and controlled.

A further condition which must be accommodated and controlled is that in which hot waste gas is flowing, then stops and then the waste gas in the stack starts to contract due to cooling. The transient purge gas flow must be initiated, monitored and controlled.

A further condition which must be accommodated and monitored is that in which failure of either purge gas supply occurs.

When the waste gas flow is above a minimum which is a function of wind speed, stack diameter, waste gas composition, and waste gas temperature, so that the waste gas purges the stack and the air cannot enter and accordingly there is no purging problem involved, either steady state or transient.

At start up, the stack and its supply header are filled with air, which is the case when no water seal is used. If a water seal is used the supply header will not contain air but the stack still is filled with air and therefore unprotected. Upon the initial introduction, or initiation of waste gas flow, a combustible gas-air mixture occurs as the air is driven out of the stack and if the pilot is functioning when this mixture reaches the pilot zone, the combustible mixture may be ignited by the pilot and an explosion may occur. If however, the stack has been or is filled with purge gas or waste gas and the possibly explosive mixture interface has passed from the stack then the pilot may be turned on without likelihood of difficulty.

If the stack is filled with air, then purge gas may be used to drive out the air but difficulties may occur if the pilot is operating before all the air has been pushed from the stack by the purge gas or waste gas. The pilot may then after sufficient purge be safely turned on when all the air has been thus purged.

If it is assumed that waste gas has been flowing to and through the flare stack with the pilot initiated and in safe operation, the purge gas flow for steady state conditions starts as soon as the waste gas flow stops. If there is a high wind at the top of the stack the entrance of air into the stack by reason of high wind may provide a condition of danger if the pilot is operating and if there is not sufficient purge gas flow for the wind condition.

Also, if the waste gas stops flowing and contraction occurs, air may enter because of the thermal contraction and produce a potentially explosive condition at the top of the stack unless transient purging is being effected.

If there is no waste gas flow and either purge gas supply fails then there is a growing potentially dangerous condition at the top of the stack. With such dangerous or potentially dangerous conditions it is advisable that the pilot be shut off as the dangerous condition approaches to avoid ignition of the explosive mixture until the loss of purge gas has been overcome.

In the event of purge gas supply failure and waste gas flow commences there is again a potentially explosive condition at the top of the stack until the air has been pushed out of the stack and thereafter the pilot can be safely reignited.

In the event that, in some manner, such as by opening an access hole, or by leakage, air enters the stack from below, an oxygen sensor gives an indication of a possible explosive condition.

The manner in which the control of the purge gas and the control of the pilot are effected will now be described in detail.

Referring now more particularly to the drawings, a flare stack 10 is illustrated having a supply conduit 11 connected thereto for the supply of waste gas from a waste gas supply connection 12 past a relief valve 13. The waste gas is combustible and is derived from industrial operations and particularly from oil refineries.

The flare stack 10 may be of any desired type, may have a fluidic seal 14, and preferably has a burner 15 at the top or discharge end, for aiding in the mixing of air for combustion, with or without steam, and may have a hollow cylindrical slotted wind shield 16 to protect the pilots 17 and the burner 15. Suitable burners are shown in my prior U.S. Pat. Nos. 3,730,673; 3,797,991; 3,822,984; and 3,995,986; but the apparatus of the present invention is applicable to a wide range of burners. A purge gas supply connection 19 is provided which communicates through a strainer 20 and a pressure regulator 21 to branch connections 22 and 23. The purge gas is usually an inert gas, a hydrocarbon gas or a combustible gas with an oxygen content too low to support combustion, or any other suitable gas with insufficient oxygen content. The branch connection 22 extends to the conduit 11, for steady state conditions, and has a proportional control valve 24 and a flow sensor 25 therein. The other branch connection 23, for transient supply, extends to the conduit 11 and has a proportional control valve 26 and a flow sensor 27 therein. A bypass line 28 is provided around the valve 24 and has a manually operable valve **28*a* therein. A bypass line 29 is provided around the valve 26 and has a manually operable valve 29*a* therein. The valves 28*a* and 29*a* are available for manual override of the valves 24 and 26** when this is desired, as in the event of system or valve failure.

While any desired type of flow sensors may be employed a suitable flow measuring system is of the thermal anemometer type such as is now available from Datametrics, a subsidiary of ITE Imperial Corporation, Wilmington, Mass. The supply conduit 11 is also provided with a flow sensor 30, similar to the flow sensors 25 and 27 for sensing flow of waste gas beyond the valve 13 and advancing towards the top of the stack 10 for discharge.

The stack 10, preferably at the lower part thereof, is provided with a temperature sensor 31, such as a thermocouple, and contiguous thereto but exteriorly disposed with respect to and shielded from the stack 10 and from the sun, a temperature sensor 32 responsive to the ambient temperature is provided. The sensors 31 and 32 are connected to a temperature comparator 33 for determining the temperature difference between the stack temperature at the location shown and the ambient temperature.

The lower part of the flare stack 10 also has an oxygen sensor 35 for continuously monitoring the oxygen content of the gas at the lower part of the stack. The oxygen sensor 35 can be of any preferred type, one suitable instrument being available as Series 326 from Teledyne Analytical Instruments, San Gabriel, Calif.

The oxygen sensor 35 is shown as having a filter 35*a*, a delivery tap 36 from the stack, a return tap and vacuum sampling pump 37 which removes a sample from the stack 10 for delivery to the oxygen sensor 35 and then returns the sample back into the stack 10. The sampling pump 37 is also positioned downstream of the filter 35*a* to avoid fouling the sensor 35 and the sampling pump 37. Three way control valves 38*a* and 38*b* are also provided for admitting and venting oxygen calibration gas, and calibration connection 39 is provided from a source of calibrating gas, such as a gas cylinder and regulator 40. The calibrating gas, preferably 95% nitrogen and 5% oxygen, is used by opening the inlet and vent valves 38*a* and 38*b* with the tap 37 and 36 closed by the three way valves 38*a* and 38*b* and supplying calibrating gas from the gas cylinder 40, through the connection 39 and through the filter 35*a* and sensor 35 for discharge to atmosphere through the vent 38*a*. A calibration signal will be available from the sensor 35 when the three way valves 38*a* and 38*b* are in the normal sampling position a signal will also be available as to the oxygen level in the stack 10.

Preferably contiguous to but spaced from the discharge end of the flare stack 10, a wind speed responsive impeller 42 is provided, preferably an anemometer, which drives a signal source 43 for a supplying a wind speed signal for utilization as hereinafter explained.

One or more gas pilot assemblies 45, comprising pilot nozzle 45*a*, pilot pipe 45*b* and pilot inspirator 45*c*, supplied with combustible gas through a pilot gas supply line 46, are provided at the discharge end of the stack 10 and controlled by solenoid controlled valves 54 for igniting the combustible waste gas and these have ignitor tips 47 with ignitor lines 48 connected thereto so that the pilot assemblies 45 can be ignited as required.

The ignitor line 48 and pilot gas supply line 46 may be controlled in any desired manner, manually or automatically, (subject to the interlock provided in the purge gas system) with pressure gages 49, 50 and 51 to indicate the pressures prevailing in these lines and with solenoid controlled valves 52, 53 and 54 for flow control.

Any suitable ignition control system 55 may be employed, one suitable system is shown in my U.S. Pat. No. 3,816,059 dated June 11, 1974 and another in my application Ser. No. 655,852 filed Feb. 6, 1976.

In order to determine the operational status prevailing the pilot assemblies 45 one or more thermocouple temperature sensors 58, with extended leads such that the thermocouple mounted in pilot nozzle 45*a* and senses the operation of the pilot to provide a signal indicating combustion or lack of combustion available at the ignitor panel 55 through thermocouple line 58*a*.

Figure 2:
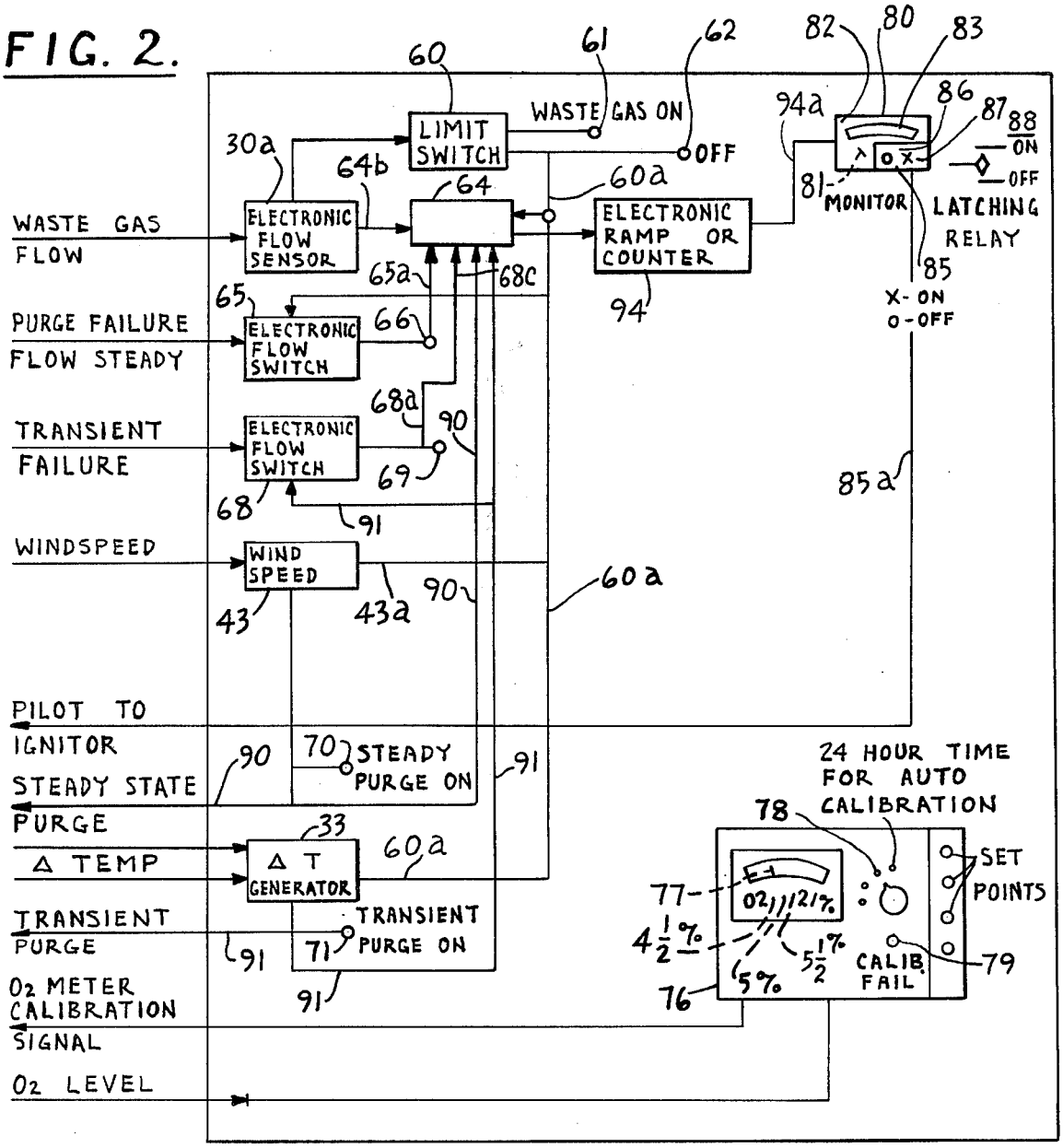
FIG. 2 is a diagrammatic view showing the details of the control system.

Referring now to FIG. 2 the mode of utilization of the various signals heretofore referred to is shown in detail. The waste gas flow sensor and signal unit 30*a* are connected through a limit switch 60 to an indicator 61 for giving a visual indication if the waste gas is flowing to the stack 10 or to an indicator 62 for giving a visual indication if there is no flow of waste gas. The signal unit 30*a* is also connected to a control unit 64, shown in FIGS. 2 and 3, for determining the actuation of the pilot 45, the ignitor panel 55, the ignitor tube 47 and pilot thermocouples 58.

The flow sensor 30 and signal unit 30*a* provide a proportional flow signal to the control unit 64 and the electronic ramp 94.

If the electronic flow sensor 30 and signal unit 30*a* and the limit switch 60 indicate no waste gas flow then the steady state purge is activated by lines 60*a* and 43*a* through the wind speed sensor 43. The flow of the steady state purge is indicated by the lamp 70. This signal through line 90 also regulates the proportional control valve 24 in direct relation to wind speed. The signal also returns to control unit 64 by line 90 for overall system logic which is explained below.

The steady state purge gas flow is monitored by the flow sensor 25 on the steady state branch connection 22 by the electronic flow switch 65 which controls actuation of a visual indicator 66 indicating steady state purge gas supply failure and is also connected to the control unit 64 through line 65*a*.

If the electronic flow sensor 30 and the signal unit 30*a* and the limit switch 60 indicate no flow then the temperature comparator 33 for the transient purge is activated through line 60*a*. If there is a temperature difference where the stack gas temperature is higher than the ambient, transient purge is initiated in proportion to the signal from the temperature comparator 33. This signal activates indicator light 71, operates the proportional control valve 26 through line 91 and sends back a signal by line 91 to control unit 64.

The transient state purge gas flow is monitored by the flow sensor 27 on the transient branch connection 23 which is also connected through an electronic flow switch 68 to a visual indicator 69 which is activated for transient purge gas flow failure. The electronic flow switch 68 is activated by a no waste gas flow condition of limit switch 60 through line 60*a*, the temperature comparator 33 and line 91.

The wind speed signal source 43 is connected to actuate the control valve 24 for steady state purge gas supply and is also connected to the control unit 64 and to a visual signal 70 indicating steady state purge gas supply through piping branch connection 22. The wind speed signal source 43 is also connected to a pointer 73 of a windspeed indicator 74, calibrated as desired in miles per hour or kilometers per hour.

The differential temperature signal available from the temperature comparator 33 is available to actuate the control valve 26 for transient purge gas supply, is connected to the control unit 64, and to a visual signal 71 indicating transient purge gas supply through the transient piping branch connection 23. This signal is made available to the control unit 64 and the visual indicator 71 through line 91. The temperature difference signal source 33 is connected to a differential temperature meter 72 with pointer 72*a* calibrated as desired in $\Delta t°$ F. or $\Delta t°$ C.

The oxygen sensor 35 is connected to an oxygen meter 76 having a movable pointer 77 movable in a range from 0 to 21% and with an intermediate operating range with high and low limit switches 77*a* and 77*b* of about 4½ to 5½ percent for daily calibration. The oxygen meter 76 can have a built in 24 hour clock 78 for automatic calibration and a visual signal 79 to indicate calibration failure controlled by the limit switches 77*a* and 77*b*. The oxygen sensor 35 and meter 76 can be manually calibrated at any time if desired. Other limit switches can be employed for high oxygen level alarm.

A purge monitor 80 is provided having a movable pointer 81 actuated through line 94*a* by a continuous signal from ramp 94 as hereinafter pointed out, and indicating the relative location of the gas-air interface. The monitor 80 has a lower band with a danger portion 82 preferably marked in red and has a safe portion 83 on its upper limit preferably marked in green. The purpose of the purge monitor 80 is to indicate the purge condition in the stack 10 and to prevent pilot and igniter actuation except at the upper and safe portion 83 of the monitor band.

The monitor 80 also gives the operator a visual check on the purge gas control system. A limit switch 85 is provided within monitor 80 having an "off" contact 86 at the lower part of the band portion 83 and an "on" contact 87 at the upper end of the band, the limit switch 85 having a latch 88 to hold it in the "on" position until the "off" contact 86 is reached upon downward movement of the pointer 81. The limit switch 85 and its latch 88 are in series through line 85*a* with the valves 53 and 54 supplying gas to the pilot 45, gas supply line 46 and the igniter line 48 to cut off pilot operation when that is not warranted by prevailing conditions at the top of the stack as indicated by the position of the pointer on the bands 82 or 83. The signal through line 85*a* also controls solenoid valve 52 to control the air to ignitor 47. The control unit 64 (see FIGS. 2 and 3) has an electronic ramp or counter 94 with a supply up and supply down control effective through the limit switch 85 and latch 88 for controlling the pilots 45 and ignitor 47.

Figure 3:
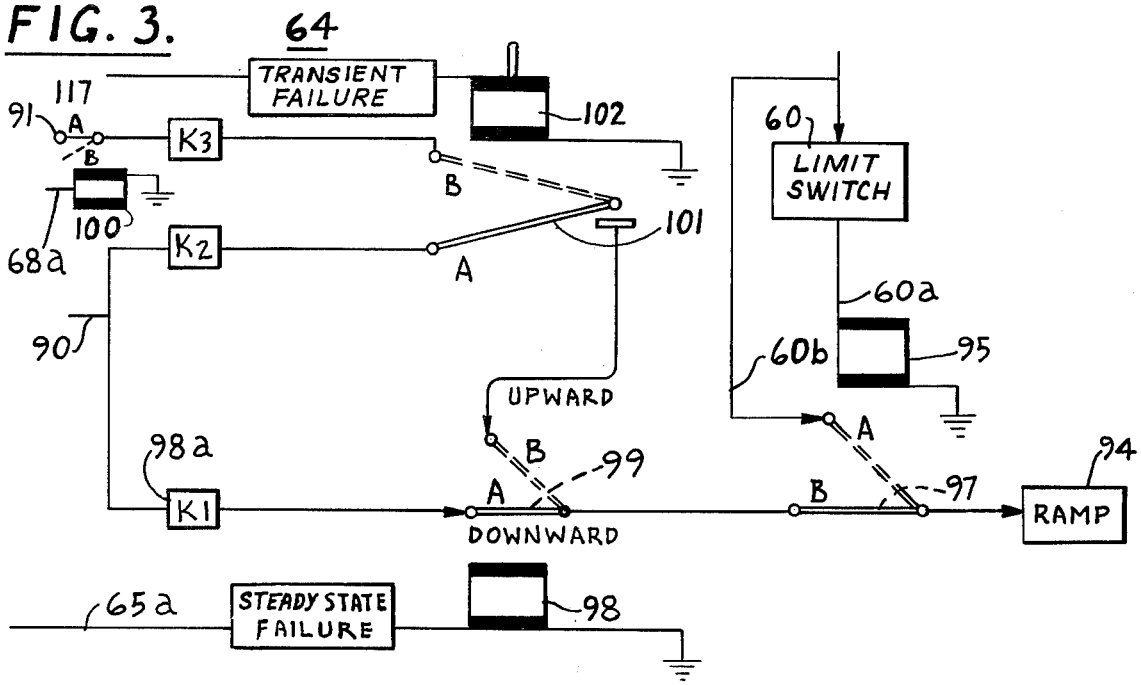
FIG. 3 is a diagrammatic view of the details of a portion of the control system interrelating waste gas flow, steady state purge gas supply, transient purge gas supply and purge failure.

Referring now to FIG. 3, a relay is provided having its coil 95 energized by a signal from the waste gas flow sensor 30 and electronic unit 30*a* through a limit switch 60 and line 60*a* which operates only when a threshold value of flow is present. The signal from the waste gas flow sensor 30 controls a contact 97 having an "A" position for direct connection of the flow sensor signal from electronic unit 30*a* through line 60*b* by-passing limit switch 60 to the electronic ramp 94 and a "B" position when there is no waste gas flow to take into account the purge gas flow.

When the contact 97 is in the "A" position the rate of the electronic ramp 94 is controlled in an upward direction proportional to the waste gas flow.

For the case where there is no waste gas flow, contact 97 is in the "B" position which directs the purge system signal to the electronic ramp 94. This signal can be either positive or negative, by means of contact 99, directing the ramp 94 upwardly or downwardly, respectively.

A purge gas flow relay 65 and a line 65*a* are provided to winding 98 controlling the contact 99. The contact 99 has an "A" position where there is no purge gas flow but a negative failure signal is desired at the electronic ramp 94 and a "B" position which is controlled by the positive signals indicating steady state or transient purge flow.

When contact 99 is in the "A" position a purge failure has occurred for the steady state, producing a negative signal to the electronic ramp 94 forcing it downward and causing pointer 81 to move down into the unsafe region 82 of meter 80. This downward rate of ramp 94 is controlled in proportion to the wind speed at the wind speed meter 42 and electronic unit 43 through line 90.

The signal is conditioned by an electronic transducer 98*a* with a set design constant K1 which results in a proportionally higher downward ramp rate with increasing wind speed.

A steady state purge gas flow is provided when by a signal from line 90 the contact 101 at the "A" position for delivery of a signal to the ramp 94, from the wind speed unit 43 through line 90. The signal produced drives the electronic ramp 94 upwardly in proportion to the wind speed. The ratio between input signal and ramp speed is set by design constant K2. The design constants K1 and K2 are different and depend on the stack diameter, flammability of the waste gas, type of purge gas and type of burner 15.

The transient purge gas flow is regulated by the temperature comparator 33 through line 91 in order to energize winding 102 and through contact 101 at position "B". An upward ramp rate greater than the steady state rate is directly proportional to the increased temperature difference between thermocouples 31 and 32 through temperature comparator 33. The greater the temperature the greater will be the upward rate. When there is no temperature difference between the thermocouples 31 and 32 then the signal from the temperature comparator 33 is zero allowing contact 101 to drop to the "A" position which gives a steady state purge.

The upward rate for the transient purge also has a design constant K3. The design constant depends on the size, and overall volume of the flare stack 10 and its supply conduit 11 back to the relief valve 13.

A failure of the transient purge as indicated by flow sensor 27 and electronic unit 68 will give an alarm indication 69 but most important is tied into the winding 100 so that it is energized upon transient purge failure, pulling contact 117 from position "A" to position "B", deenergizing the coil 102 and going to steady state purge.

A transient purge gas flow failure is not a major source of danger because the steady state purge is a partial backup, but an indication is given at lamp 69 and the condition should be corrected as soon as possible.

A steady state purge gas flow failure is a greater potential source of danger since then all purge flow could be shut off which not only is indicated by lamp 66 but also takes over main control of the electronic ramp 94 through winding 98 and contact 99 whenever there is no waste gas flow. It should be understood that the waste gas can itself act as a purging medium. The purge gas flow failure indicator lamps 66 and 69 will continue to remain lit even if there is waste gas flow until the purge gas flow has been restored as an additional safety feature for the operating personnel.

This arrangement of relays and their contacts accommodates the conditions which are encountered and provides proper monitoring. If there is waste gas flow a circuit is established to energize the winding 95 and deliver a signal variable in accordance with the waste gas flow through the ramp 94 and to the monitor 80, the ignitor 47 and pilot 45 being activated if the flow level is sufficient to be in the upper range of the monitor 80.

Figure 4:
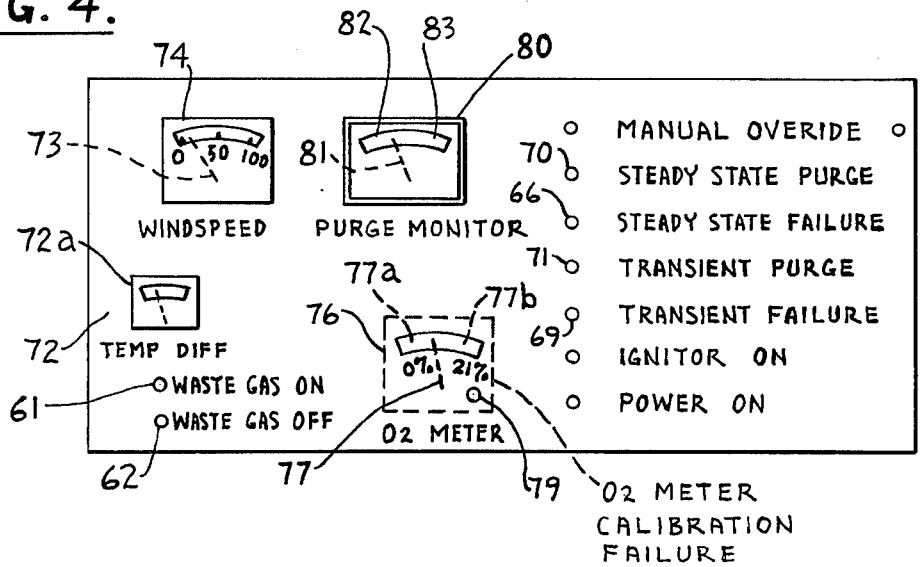
FIG. 4 is a view in elevation of an indicating panel employed in connection with the control system of FIG. 2.

In FIG. 4 an indicating panel is shown which includes the windspeed indicator 74, the purge monitor 80, the oxygen meter 76, the temperature difference meter 72 and the various indicating lights for various conditions encountered as to the waste gas flow on or off, steady state purge or failure, transient purge or failure, ignitor on, power on, and manual override buttons.

I claim:

1. Control apparatus for a flare gas stack which comprises in combination with a flare gas stack a connection to said stack from a supply of waste combustible gas for combustion at the discharge end of the stack, a connection to said stack from a supply of purge gas for controlled delivery of purge gas to said stack, a gas pilot burner for igniting of gas at the discharge end of the stack, and means for controlling the operation of said pilot burner, said means including a flow sensor for said stack for preventing activation of said pilot burner when no gas flow in said stack is sensed by said flow sensor.

2. Control apparatus as defined in claim 1 in which said flow sensor is responsive to flow of waste combustible gas to said stack.

3. Control apparatus as defined in claim 1 which said flow sensor is responsive to flow of purge gas to said stack.

4. Control apparatus for a flare gas stack which comprises, in combination with a flare gas stack, a connection to said stack from a supply of waste combustible gas for combustion at the discharge end of the stack, a connection to said stack from a supply of purge gas, a gas pilot burner for ignition of gas at the discharge end of the stack, and a windspeed indicator contiguous to said stack having a windspeed signal transmitter operated thereby, and means for controlling the operation of said pilot burner, said means being controlled by a signal from said windspeed signal transmitter.

5. Control apparatus as defined in claim 4 in which said means also includes members for controlling the supply of purge gas to said stack.

6. Control apparatus as defined in claim 4 in which said means also includes members responsive to the temperature differential interiorly and exteriorly of said stack for controlling the activation of said pilot burner.

7. Control apparatus as defined in claim 4 in which a gas flow sensor is provided for said stack, said means also includes members responsive to a signal from said gas flow sensor for preventing activation of said pilot burner when no gas is flowing in said stack.

8. Control apparatus as defined in claim 4 in which indicating means is provided for said windspeed signal.

9. Control apparatus as defined in claim 4 in which a purge monitoring indicator is provided responsive to said windspeed signal, purge gas flow and waste gas flow.

10. Control apparatus as defined in claim 9 in which temperature sensors are provided for the temperature inside the stack and the ambient temperature, and said purge monitoring indicator is also responsive to the differential of said temperatures.

11. Control apparatus for a flare gas stack which comprises, in combination with a flare gas stack, a connection to said stack from a supply of waste combustible gas for combustion at the discharge end of the stack, a connection to said stack from a supply of purge gas for controlled delivery of purge gas to said stack, a gas pilot burner for ignition of gas at the discharge end of the stack, and means for visually monitoring the conditions in said stack, said means including a visual indicator controlled by waste gas flow, purge gas flow and temperature conditions inside and outside the stack.

12. Control apparatus as defined in claim 11 in which said visual indicator is also controlled by the windspeed adjacent said stack.

13. Control apparatus as defined in claim 11 in which said portion has a part indicating unsafe conditions for pilot burner activation and a part indicating safe conditions for pilot burner activation, the pilot burner being locked against activation in said unsafe indicating part.

14. Control apparatus as defined in claim 11 in which oxygen content sensing apparatus is provided in communication with the interior of said stack, and said panel has oxygen content indicating means activated by said oxygen sensing apparatus.

15. Control apparatus as defined in claim 11 in which a windspeed indicator contiguous to said stack has a signal transmitter operated thereby, and said monitoring panel has a windspeed indicator responsive to the signal from said transmitter.

16. Control apparatus for a flare gas stack which comprises, in combination with a flare gas stack a connection to said stack from a supply of waste combustible gas for combustion at the discharge end of the stack, a connection to said stack from a supply of purge gas, and waste gas flow sensing and signaling members, means for controlling the supply of purge gas to said stack, said means including valve members for controlling purge gas delivery, members responsive to non-flow of waste gas for permitting purge gas flow, and windspeed sensing and signaling members, control members for said valve members controlled by said windspeed sensing and signaling members for controlling said purge gas delivery valve members.

17. Control apparatus as defined in claim 13 in which temperature sensors are provided for the temperature inside the stack and the ambient temperature, and said control members for said valve members are also controlled by the difference between said temperatures.

18. Control apparatus for a flare gas stack which comprises, in combination with a flare gas stack, a connection to said stack from a supply of waste combustible gas for combustion at the discharge end of the stack, a connection to said stack from a supply of purge gas, and means for controlling the supply of purge gas to said stack, said means including valve members for controlling purge gas delivery, windspeed sensing and signaling members, and control members for said valve members controlled by said windspeed sensing and signaling members for controlling said purge gas delivery valve members.

19. Control apparatus for a flare gas stack which comprises, in combination with a flare gas stack a connection to said stack from a supply of waste combustible gas for combustion at the discharge end of the stack, waste gas flow sensing members, a connection to said stack from a supply of purge gas for controlled delivery of purge gas to said stack, purge gas flow sensing members, a gas pilot burner for ignition of gas at the discharge end of the stack, and a monitoring panel for indicating conditions in said stack, said panel having waste gas and purge gas flow indicating members, and means for indicating the relative location of the gas/air interface in said stack.

20. Control apparatus for a flare gas stack which comprises, in combination with a flare gas stack, a connection to said stack from a supply of waste combustible gas for combustion at the discharge end of the stack, temperature sensing means in said stack, a connection to said stack for supplying transient purge gas to said stack controlled by said temperature sensing means, a connection to said stack for supplying steady state purge gas to said stack, purge gas flow sensors for each of said purge gas connections, and means for indicating the delivery of purge gas.

* * * * *